United States Patent [19]

Petersen

[11] Patent Number: 4,948,109

[45] Date of Patent: Aug. 14, 1990

[54] METHOD AND SYSTEM OF ASSEMBLING AND ADDRESSING INDIVIDUALIZED COMPOSITE PRINTED PRODUCTS

[75] Inventor: Godber Petersen, Augsburg, Fed. Rep. of Germany

[73] Assignee: Man Roland Druckmaschinen AG, Offenback am Main, Fed. Rep. of Germany

[21] Appl. No.: 308,411

[22] Filed: Feb. 8, 1989

[30] Foreign Application Priority Data

Feb. 25, 1988 [DE] Fed. Rep. of Germany ..... 3805915

[51] Int. Cl.[5] ..... B41F 13/54

[52] U.S. Cl. ..... 270/1.1; 270/55; 270/57; 270/58

[58] Field of Search ..... 270/1.1, 54, 55, 56, 270/57, 58; 53/411, 501, 131, 52, 392

[56] References Cited

U.S. PATENT DOCUMENTS

| | | | |
|---|---|---|---|
| 3,122,362 | 2/1964 | Vollrath | 270/57 |
| 3,924,845 | 12/1975 | Wise | 270/54 |
| 4,168,828 | 9/1979 | McLear | 270/54 |
| 4,484,733 | 11/1984 | Loos | 270/54 |
| 4,840,365 | 6/1989 | Kobler | 270/55 |

FOREIGN PATENT DOCUMENTS

| | | | |
|---|---|---|---|
| 80584 | 6/1983 | European Pat. Off. | 270/55 |
| 1436501 | 10/1969 | Fed. Rep. of Germany | 270/57 |
| 2243030 | 3/1973 | Fed. Rep. of Germany . | |
| 3644422 | 5/1988 | Fed. Rep. of Germany . | |

*Primary Examiner*—Edward K. Look
*Assistant Examiner*—Therese M. Newholm
*Attorney, Agent, or Firm*—Frishauf, Holtz, Goodman & Woodward

[57] ABSTRACT

To permit preparation of inserts or special sections for newspapers, selected in accordance with individual subscriber, distributor or regional dealer wishes, inserts or sections (100,102) are selected in accordance with these wishes, under control of a computer-controller (112) and selectively assembled to form intermediate products (115). The intermediate products are coded in accordance with product distribution address sequences, and can be stored until they are to be merged with the daily news section of the newspaper, for example the masthead section, for rapid assembly therewith, while retaining the address codes and the product distribution sequence. The completed newspaper is then addressed, upon reading the address codes, and can be immediately bundled or packaged for delivery to a delivery truck (111) whose route follows the sequence of the distribution addresses of the pre-addressed individualized combined newspaper.

20 Claims, 21 Drawing Sheets

METHOD AND SYSTEM OF ASSEMBLING AND ADDRESSING INDIVIDUALIZED COMPOSITE PRINTED PRODUCTS

The present invention relates to a method and a system to assemble and address composite printed products in which the composite printed products are personalized or individualized, for example newspapers, magazines and other publications which have a basic section and inserts or additional sections which are specified to selected subscribers or groups or subscribers. The selected subscribers or groups of subscribers may be geographically diverse.

BACKGROUND

When preparing newspapers, and particularly newspapers which are widely distributed over geographically dispersed metropolitan areas, it is customary to provide a basic or main section which includes the latest news; and in addition, various other sections and, if desired, inserts, for example advertisement inserts. The additional sections may not include fast-breaking news, but may contain matter of general interest, for example fashion news, science reviews, articles about real estate and developments, including real estate advertisements and the like, which can be prepared in advance and well before the "news" section or portion of the newspaper is printed. In addition, and particularly if the newspaper is distributed about geographically diverse metropolitan areas, specific regional news may also be included, which vary from region to region. Thus, the newspaper may have a first or general news section which can print news about events which occurred up to a deadline which may, for example, be close to midnight, for distribution in the morning. After the newspaper has been printed, and the pages folded, the additional sections can be added, and then the newspaper is assembled with other papers for distribution, for example for distribution by delivery trucks to specific portions of a city, even specific streets, or to specific addresses; or to suburbs or metropolitan regions. The individual distribution of newspapers to specific subscribers may be done locally, that is, by local distributors.

Printed products, such as magazines and newspapers, frequently include inserts or added sections, for examples in form of folded advertising inserts or single-sheet advertising inserts which may also include merchandise coupons. These insers and additions are to be added to the main or "news"section of the newspaper. It was customary to provide the main or "news" section of the newspaper and then, for specific regions, introduce the inserts or subsections which were all identical, at least for a specific region. The time pressure for adding the additional subsections is substantial, and, since it is to be added to the "news"section, must be inserted in the "news" section when it comes off the printing press, that is, at the last minute. Thus, newspapers which are intended to be distributed to a specific region, for example to a specific suburb or a specific community, all had the same inserts applied, simply because it was economically impossible to differentiate or select specific inserts under the time pressure. It was not possible, for example, to add only respectively requested inserts for specific subscribers although their delivery addresses were next door to each other. Within the time available, it was not possible to differentiate and individualize or personalize the inserts for specific subscribers; thus, all subscribers within a given region or delivery zone had to get all the inserts which, however, may be of interest to only a few of the subscribers.

THE INVENTION

It is an object to provide a method, and a system to carry out the method, to provide printed products, especially newspapers, in which the same main section, for example the news section, of a newspaper can be supplied with different numbers and/or types of previously printed products, such as inserts, standard sections, or the like, in order to complete the overall newspaper, in which completion of the overall newspaper can be carried out in a single insertion or association step or cycle, for example immediately after the main section has been provided.

Briefly, a storage means is provided to retain a plurality of different inserts or sections. A computer-controller retains and stores addresses of subscribers and/or distribution outlets, and/or address patterns, for example representative of distribution routes or delivery vehicles for specific distribution routes.

Under control of the computer controller, selected ones of the inserts or sections are received from the product mixing or storage elements to form intermediate products. The computer-controller controls the selection of respective inserts or sections in accordance with stored data identifying receiver addresses and the specific inserts or sections to be delivered to the specific receiver addresses. The intemediate products are coded with a receiver address distribution sequence, the code being representative of sequences of addresses of the receiver for delivery of the products to the receiver addresses. The intermediate products are retained in an intermediate product retention or storage structure. The intermediate products, already coded, are then merged with identical common product sections, for example the latest "news" sections of the newspaper, and received from a common product delivery apparatus, for example directly from a printing press and associated equipment, such as a folding former. The sequence of the receiver addresses continue to be retained, and a common composite printed product will then be obtained in which the sequence of the receiver addresses continues to be identified. The composite printed products are then addressed by applying a delivery address to the common printed product in accordance with the receiver addresses as represented by the codes of the intermediate products.

The method and system of the invention has the advantage to permit assembly of "individualized" or "personalized" newspapers in the shortest possible time and with a minimum of effort, and human intervention. It permits association of the latest "news" section of the newspaper and carrying, for example, the papers' masthead, with various previously printed sections and/or inserts. It permits, thus, to supply to individual subscribers or customers of the paper, the names and addresses of whom are known, the newspaper that they actually want, that is, the news section and only those additional sections and/or inserts which they wish to receive and which are of interest.

For example, a subscriber may wish to receive all advertising material and offers and sales flyers regarding foot items; another subscriber may wish to receive only advertising and special sections relating, for example, to fashion; whereas as still others may wish to receive all inserts or special sections relating to travel, recreation or sports; and others, again, may have a special interest in home furnishing, furniture and the like. It is equally possible to supply to all subscribers within a certain geographical district, suburb, county or region special sections or inserts and carrying news and/or offers and advertising of businesses in the specific geograpical region.

DRAWINGS

DETAILED DESCRIPTION

Figure 1:
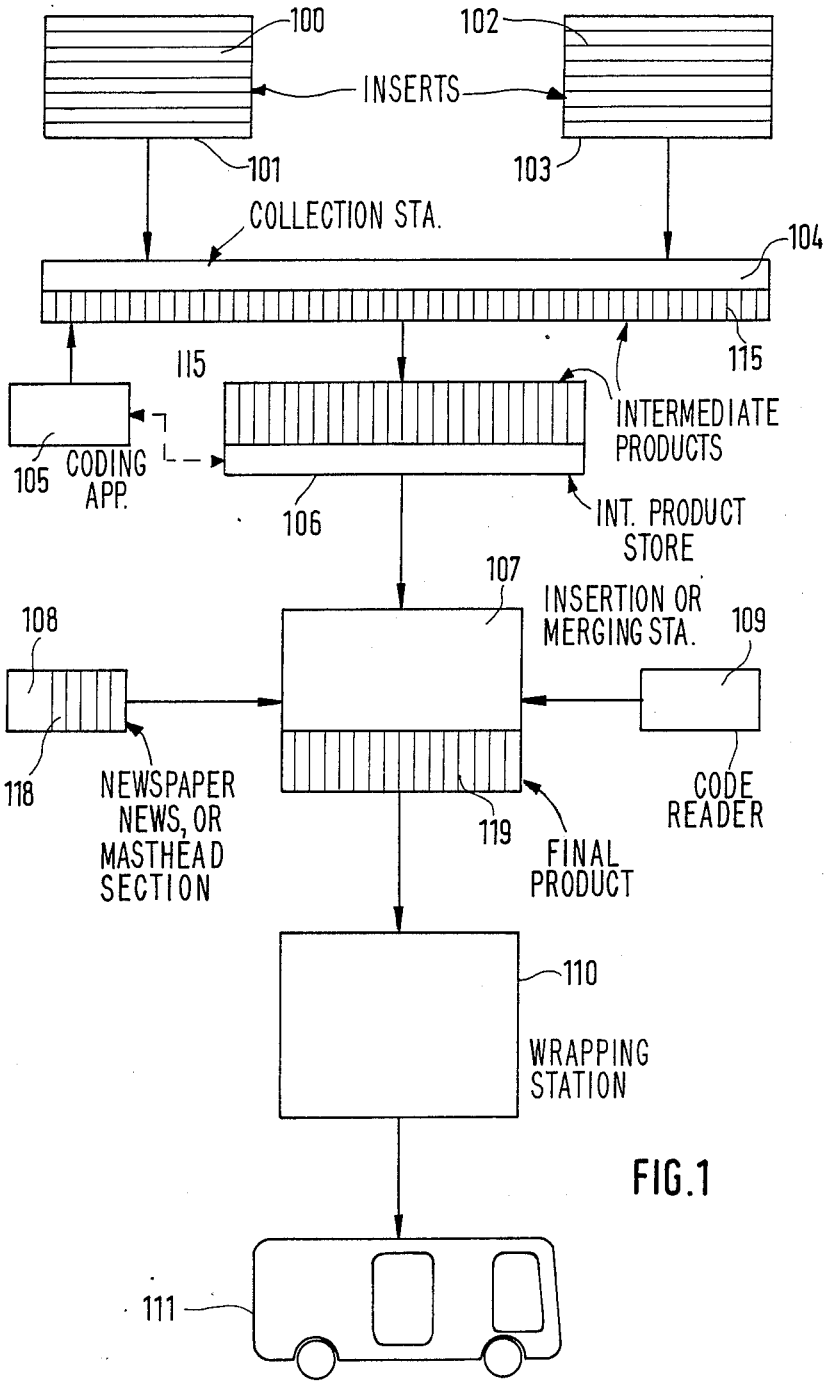
FIG. 1 is a highly schematic block diagram of a system to generate printed products in accordance with the present invention.
Figure 2:
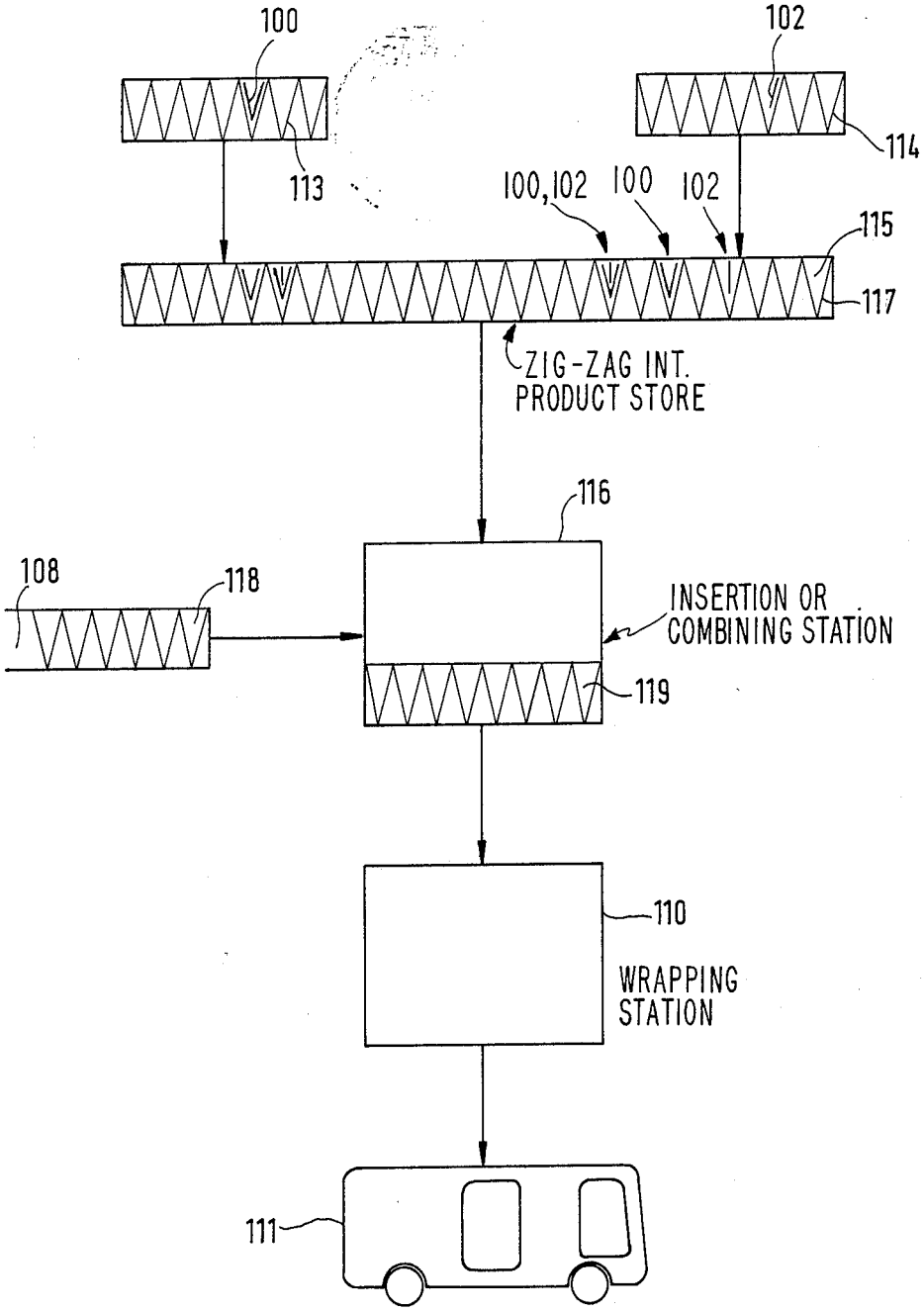
FIG. 2 is a diagram similar to FIG. 1, and illustrating a modification.
Figure 3:
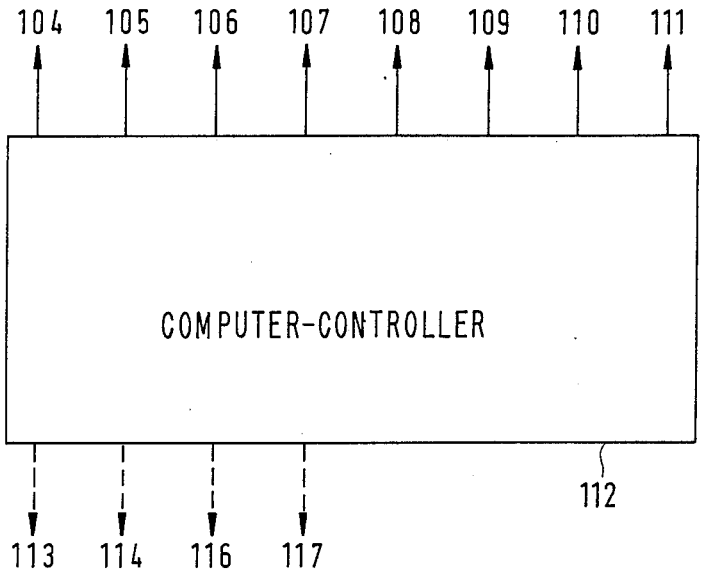
FIG. 3 is a block diagram illustrating the controls obtainable by a computer-controller unit.

The overall system will be described first, and as illustrated in FIGS. 1–3. FIGS. 9–26, in general, show the system carrying out the method for fully automatically generating individual intermediate products which can be associated with a "news" section, while being coded for individual distribution to predetermined selected subscribers, distributor addresses, regions, or distribution routes in a predetermined address pattern.

Referring first to FIG. 1, which illustrates, in block diagram form, a first embodiment of the system of the invention, which carries out the method thereof.

Differing inserts 100, 102, are supplied, for example on storage pallets 101, 103. These inserts may be provided, for example, by the newspaper in pre-printed form, by advertising agencies, or the like, for example from different producers or sources. The inserts 100, 102 are supplied in the form of folded or sheet-like initial products. The inserts can be stacked or otherwise supplied to or by a printed or the printing plant of the newspaper which is to, eventually, supply the printed newspaper product. After the main section of the newspaper, for example the "news" section and carrying its masthead, is provided, the respective inserts or sections 100, 102 are associated with the main section to form the final newspaper. The news or masthead section is schematically shown at 118, derived for example from a printing machine 108 which has just printed the latest news.

The initial products 100, 102 are collected in a collection station 104, which, preferably, includes a feeder. Such collection stations with feeders usually also include controlled mixing apparatus, particularly associated with the products to be handled, which may be electronically controlled. The initial products 100, 102 are placed into the collecting station 104 in accordance with a product distribution address sequence or pattern. The product distribution address sequence is stored in, and can be obtained from a computer controller 112 (FIG. 3). The computer-controller 112 includes a code in which the address of individual subscribers are retained, as well as the specific inserts desired by the particular subscribers, and the delivery sequence or pattern, or destinations of specific regions or distribution routes. The collection station 104, thus, generates intermediate products 115. The intermediate products 115 can be stored in a storage holder, for example a storage cassette, where they can be held until required. The intermediate product store 106 forms an intermediate storage arrangement.

The computer-controller has recorded and stored therein the addresses of the receivers of the printed products, for example subscribers. Knowing the addresses of the subscribers, it is easily possible to determine a suitable distribution route, for example a street on which a group of subscribers lives. Thus, the distribution address sequence can be obtained from the computer. The newspaper publisher, and/or the provider of the printed products 100, 102, after prior inquiry with the newspaper subscribers, will also know the individual desires of the subscribers; alternatively, the suppliers of the inserts or special sections may wish to supply specific regions or addresses with particular inserts. Thus, since the individual desires of the subscribers or their suppliers, are known, the computer-controller can readily determine in which way the pressurized products 100, 102 are to be combined to form the respectively desired combinations of inserts for a specific distribution route. For two pre-products 100, 102, four possibilities will result for any delivery address or, respectively, for any one subscriber. For example:

(1) A first subscriber may wish to receive the masthead section 118, and both inserts 100 and 102;

(2) a second subscriber wishes the masthead section 118 and product 100;

(3) a third subscriber wishes the masthead section 118 and inserts 102; and (4) a fourth subscriber wishes to receive only the news or masthead section.

Intermediate products 115, then, are generated in the collection station 104 in accordance with the above-described four possibilities.

As the number of initial products 100, 102 increases, the possible combinations increase exponentially.

The collection station 104 may include, also, a combination or insertion station in which the intermediate products required by specific subscribers can be joined together at that time. A coding apparatus 105 provides a code to the intermediate products 115 which is indicative of the contents of the package formed by the intermediate products, that is, which ones of the inserts, e.g. 100, 102 and such other inserts 100*n* (not shown) are combined in the collection station. The code is readable by reading the specific code assigned thereto. Succeeding addresses within a predetermined distribution sequence or distribution route, will have their own individual intermediate products assembled in the collection station 104 so that, for that individual subscriber, or similar group of subscriber at one address pattern, such as a distribution station in a specific geographical region, will have individual intermediate products 115 derived from the inserts or base products 100, 102. . . 10*n*, each characterized by a suitable code, derived from the coding apparatus 105, to indicate what the packages or intermediate products contain. The collection station, thus, provides the intermediate products 115, sequentially, in accordance with a predetermined addess sequence or pattern, corresponding for example to a distribution route, by considering the known product distribution address sequence, and the individual requirements of the specific inserts. As a result, a sequence of individual intermediate products 115 will be obtained, separately and individually coded, and stored in the intermediate store 106. The intermediate store 106 may, also, be coded as such if for large distribution regions, one or more storage bins or storage cassettes forming the intermediate store 106 are needed. Since the coding of the intermediate product store 106 may depend on circumstances which are not necessarily required, the connection from the coding apparatus 105 to the intermediate store 106 is shown in broken lines.

The assembly and coding steps and system, described above, has the advantage that individual intermediate products 115 can be generated, independently of the production of the main product, for example the newspaper news or masthead section of the final product to be delivered. The main production, hereinafter for simplicity referred to as the "masthead section", and containing, for example, the latest news of the day, has to be provided at the last minute before distribution; the intermediate products can be provided many hours, days or even weeks in advance. Checking of the intermediate products likewise can be carried out without time pressure, for example in the intermediate product store 106, in order to eliminate possible errors and detect error sources and to correct defects.

A a predetermined instant of time, for example early in the morning, a printing machine 108 provides the masthead section 118 with the latest news. The masthead sections 118, after folding and handling as well known in the newspaper manufacturing plants, are then delivering to an insertion or merging station 107. The particular intermediate product store 106, which may be cassette, a storage roll, or the like, is applied to the insertion or merging station 107 destined for a specific distribution route, served for example by a distribution truck 111, as soon as the masthead section 118 is available. A code reader 109 determines the position of the respective intermediate products 115 in the intermediate product store 106. Upon insertion of an intermediate product 115 into a masthead section 118 at the insertion or merging station 107, the masthead section or a cover therefor, can be addressed. The code of the individual intermediate product is read by the code reader so that the address of the subscriber or distribution section which required the particular intermediate product can be associated with the contents of the intermediate product. The code used may be any well known machine readable code, suitable for scanning and reading by the code reader; a bar code is suitable. Addressing can be carried out directly on the masthead section, or after wrapping the masthead section or a group of them for distribution, for example by insertion in a plastic foil, strapping or the like. By associating the individual intermediate products 115 to the masthead section 118, a main or composite unit 119 is obtained which, however, is individualized or personalized, carrying the name of the recipient, for example an individual subscriber, in which the intermediate product 115 is individualized for the particular recipient, and, further, is provided in a sequence which is appropriate for a distribution route, namely corresponding to the address distribution sequence, so that a delivery truck 111 can follow an efficient and short delivery path.

The finished, completed newspaper 119, formed by the merger of the masthead section and the intermediate product 115, is then transferred to a wrapping station 110 for wrapping which may, for example, include a cross positioning wrapper, for delivery to a delivery station, for example a delivery truck 111.

Connection of computer 112 is shown in FIG. 3 by the arrows 104'–111'. Similar lines and arrows have been omitted from FIGS. 1 and 2 for clarity of the drawing.

The method described in connection with FIG. 1, and the system of FIG. 1, thus readily permits synchronizing the movement of delivery vehicles 111 destined to receive newspapers for a predetermined route with the particular papers to be delivered by the route by recalling the appropriate intermediate product store 106. Associating the pre-arranged intemediate products 115 with the then printed masthead sections 118, can be carried out rapidly. In one single step, the newspaper masthead section 118 and the intermediate products are assembled to form the complete newspaper, that is, the final product, including addressing and wrapping. In efficient manner, and with a high degree of reliability in shortest time, the vehicle 111 can then be supplied with the individualized newspaper for the specific route which is to be covered by the vehicle 111.

FIG. 2 illustrates, in highly schematic form, a modified embodiment. All components and products identical to FIG. 1 have been given the same reference numeral. The embodiment of FIG. 2 also is associated with the computer-controller 112 (FIG. 3) and, in addition to the connection lines shown in FIG. 3, is coupled to the computer-controller by the connection lines shown in broken-line form to elements 113 to 117.

The primary difference between the embodiments of FIGS. 1 and 2 is this: Storage structures are used in which individual initial products 100 and the intermediate products 115 are located in unique storage positions, which can be uniquely characterized or coded e.g. by a bar code. Thus, coding of the combined intermediate products 115, according to FIG. 1, by use of the coding apparatus 105, and subsequent reading with the reader 109, is then not necessary.

Storage structures for reception of various initial products 100, 102 are schematically indicated at 113, 114. The storage structures 113, 114 can be completely filled with inital products 100, 102. Alternatively, they can be supplied with initial products already in a predetermined product distribution addess sequence, and corresponding to an individual code, determine the specific inserts, placed at predetermined storage locations, in which the specific inserts are to be supplied to specific delivery addresses. The individual intermediate products 115 are then stored in a similar storage structure 117 in which they can be inserted, for example by placing one storage structure 113 above a storage structure 117 and inserting the inserts 100 into the storage structure 117; thereafter, the second structure 114 is placed over the storage structure 117 and, upon retaining of the sequence of stored inserts in storage structure 113, the inserts are transferred into the storage structure 117, in the same sequence, and selectively combined with previously stored inserts 100, if required by a specific subscriber or for a specific distributor. The individualized or personalized intermediate products 115, retained in the storage structure 117, then can be stored again and characterized by their location in storage structure 117; if desired, they could also be coded, although this will not be necessary. Storage structure 117 can remain in storage until the masthead section 118 become available.

The individualized storage products 115 can then be recalled by recalling the storage structure 117 when a distribution route vehicle 111 arrives. The storage structure 117, upon recall, is then placed in association with an insertion apparatus 116 which, as known, combines the intermediate products 115 with the masthead section 118. The respective intermediate products 115, thus, are inserted at the insertion station 116 while retaining the individual sequence, as well as the combination of inserts required, with one of the masthead sections 118. The subsequent steps, for example addressing, placing into a foil, wrapping or packaging and the like, can be carried out as previously described.

Suitable storage structures, particularly of the accordion-pleat type, and insertion apparatus and the like, are described in the referenced applications and patents, and specifically application Ser. No. 07/056,786, filed May 29, 1987, now U.S. Pat. No. 3,840,365

Ser. No. 07/060,764, filed Jun. 10, 1987, now U.S. Pat. No. 4,828,242

Ser. No. 07/137,243, filed Dec. 23, 1987, now U.S. Pat. No. 4,871,159.

Figure 4:
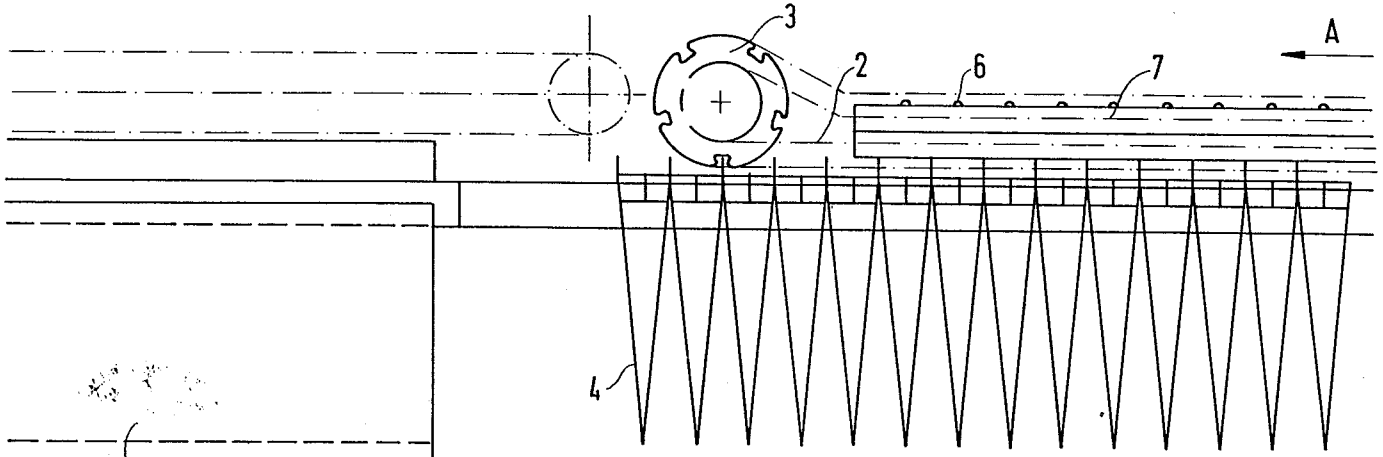
FIG. 4 is a highly schematic side view of part of an apparatus to carry out the invention.
Figure 5:
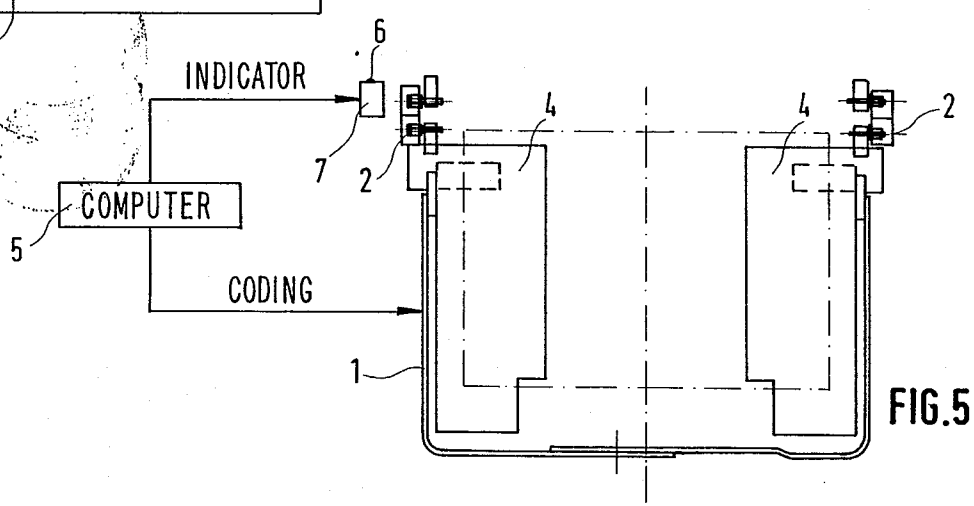
FIG. 5 is a fragmentary schematic end view of FIG. 4, in which the system of FIGS. 4 and 5 require manual operation.

FIGS. 4 and 5 show a simple arrangement to generate the individual intermediate products 115, FIG. 5 being a view of FIG. 4 in the direction of the arrow A (FIG. 4). A storage cassette 1, forming the intermediate store, is moved to a transfer position, and the storage structure 4 therein, forming a zig-zag structure referred to in the above-referenced applications and patents, is pulled out or expanded along its length. A chain 2, running over a sprocket 3, pulls out the respective individual pocket structures 4. The individual chambers or pockets of the structure 4 can be readily identified, for example by a code applied thereto, so that it can be determined which products are in which chamber. In a simple way, this can be carried out by merely electronically counting the respective chambers, so that, in a specifically counted or placed chamber, that number of inserts is placed which are to be associated in one intermediate product package. For example, the inserts may be advertising material, to be delivered to a predetermined product distribution address sequence, and, further, the specific inserts being associated with a specific recipient address within that distribution sequence. Thus, individual prospectus material, advertising or special sections of the newspapers are introduced into the storage structure elements 4, so that, at subsequent addressing of the complete newspaper or final product 119, a clear association will obtain between the final product and a predetermined clearly identifiable product package.

A simplified computer 5 can control indicators, for example indicator lamps secured to an indicator strip 7, which by selectively colored illumination for example indicate which chambers of the storage structure should have which inserts applied thereto. The inserts can be inserted manually, for example by operating personnel. Typical inserts are, for example, fashion advertising material. This step can be continued, as desired, for difference types of inserts, and inserts can be placed individually or in groups in the respective holders or chambers formed by the holders as shown at 4, FIG. 4. For example, upon calling up from the computer 5 all those chambers which are to have a fashion insert placed therein, the lights for the respective chambers, to be associated with specific addresses, will light. Next, the computer 5 can be asked to indicate which of the chambers are to have sports sections added. Some chambers will have fashion and sport inserts, others only sports or fashion inserts, and others neither. This sequence can be continued, as desired, for any product, or other insert to be placed. When the number of the insert products have been placed into the respective chambers 4, so that the overall storage structure retains the desired individual intermediate products 115, the structure 4 can be collapsed and reintroduced into the cassette 1 to be stored until the masthead section is printed. The storage cassette 1, preferably, is coded so that it can be readily identified at a later time to associate the cassette with predetermined distribution routes, that is, to consider the subscriber distribution adddress sequence of the insert stored in the cassette 1.

Figure 6:
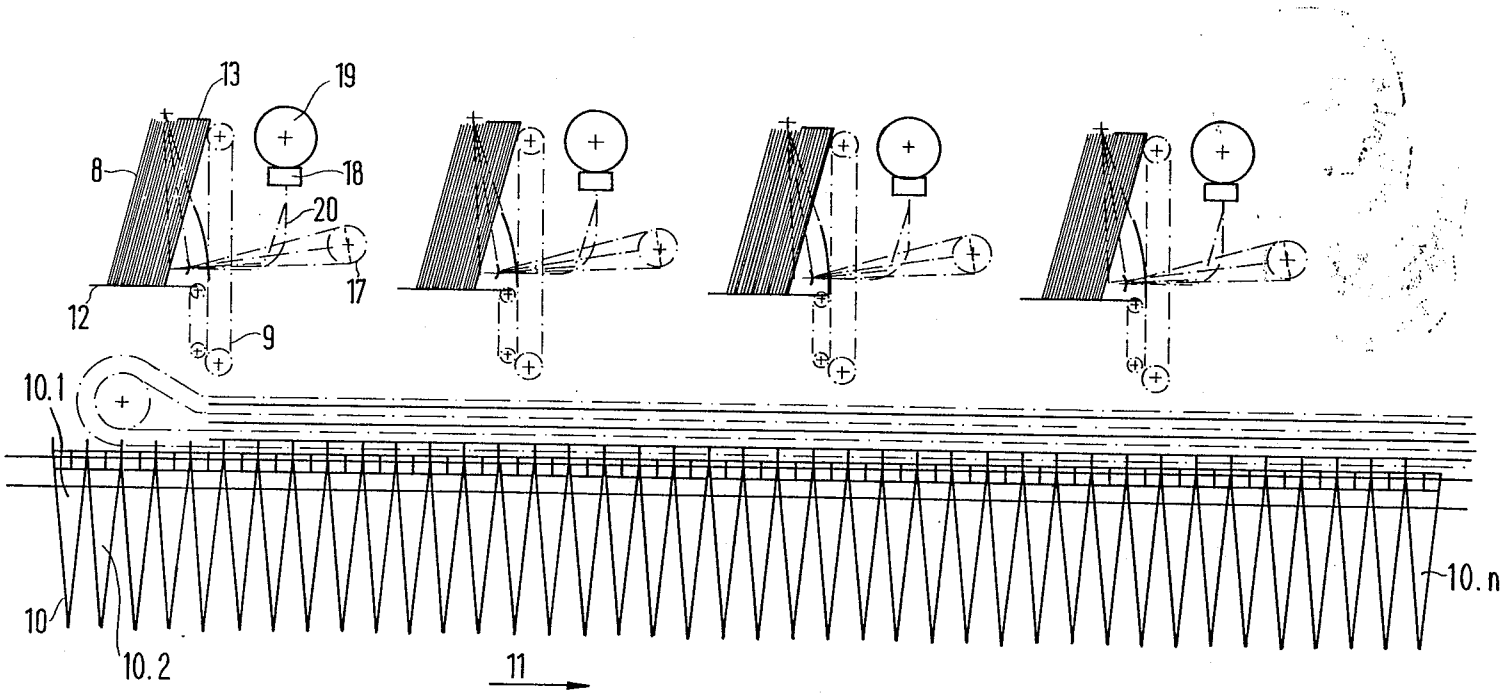
FIG. 6 is a schematic side view of a semi-automatic assembly of individualized intermediate products.
Figure 7:
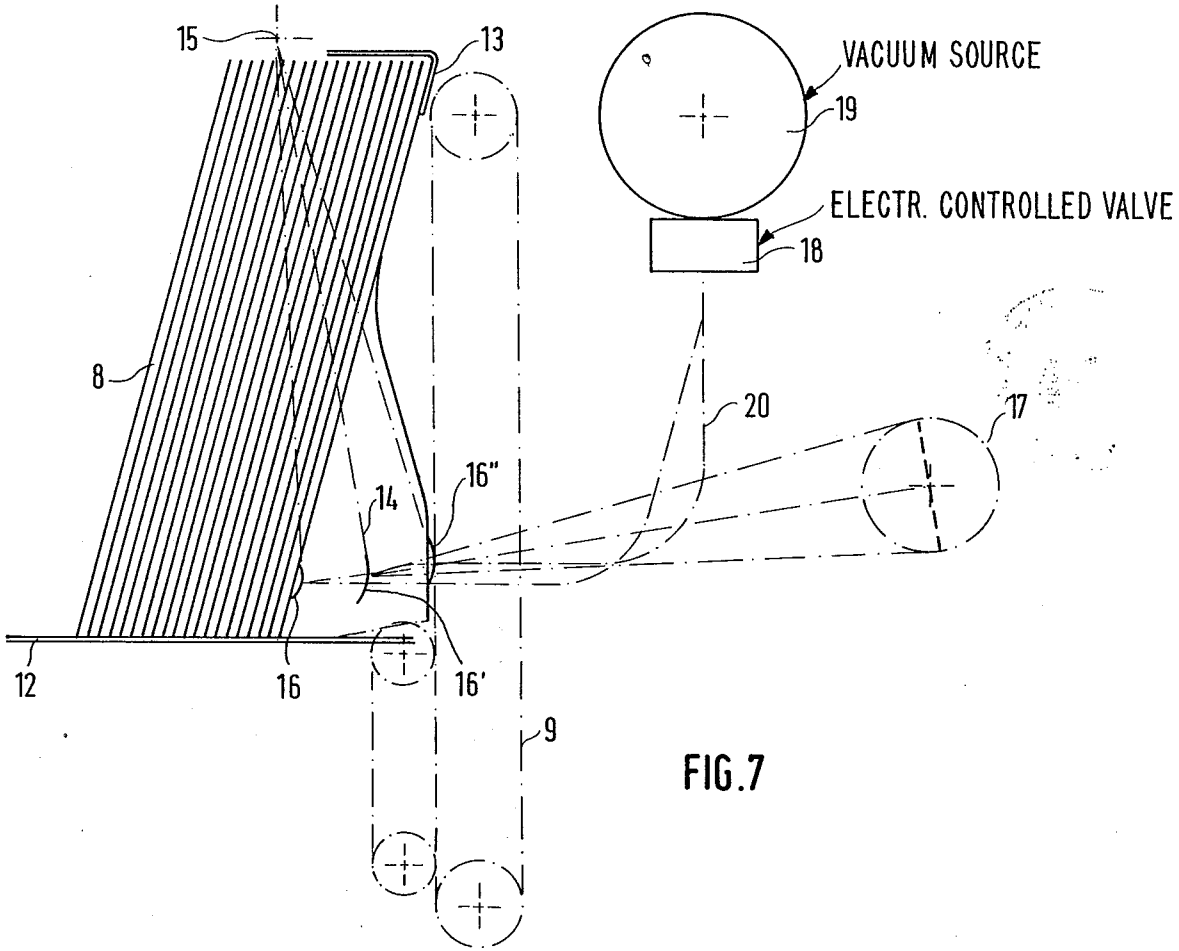
FIG. 7 is a fragmentary detailed view of a portion of FIG. 6, to an enlarged scale.
Figure 8:
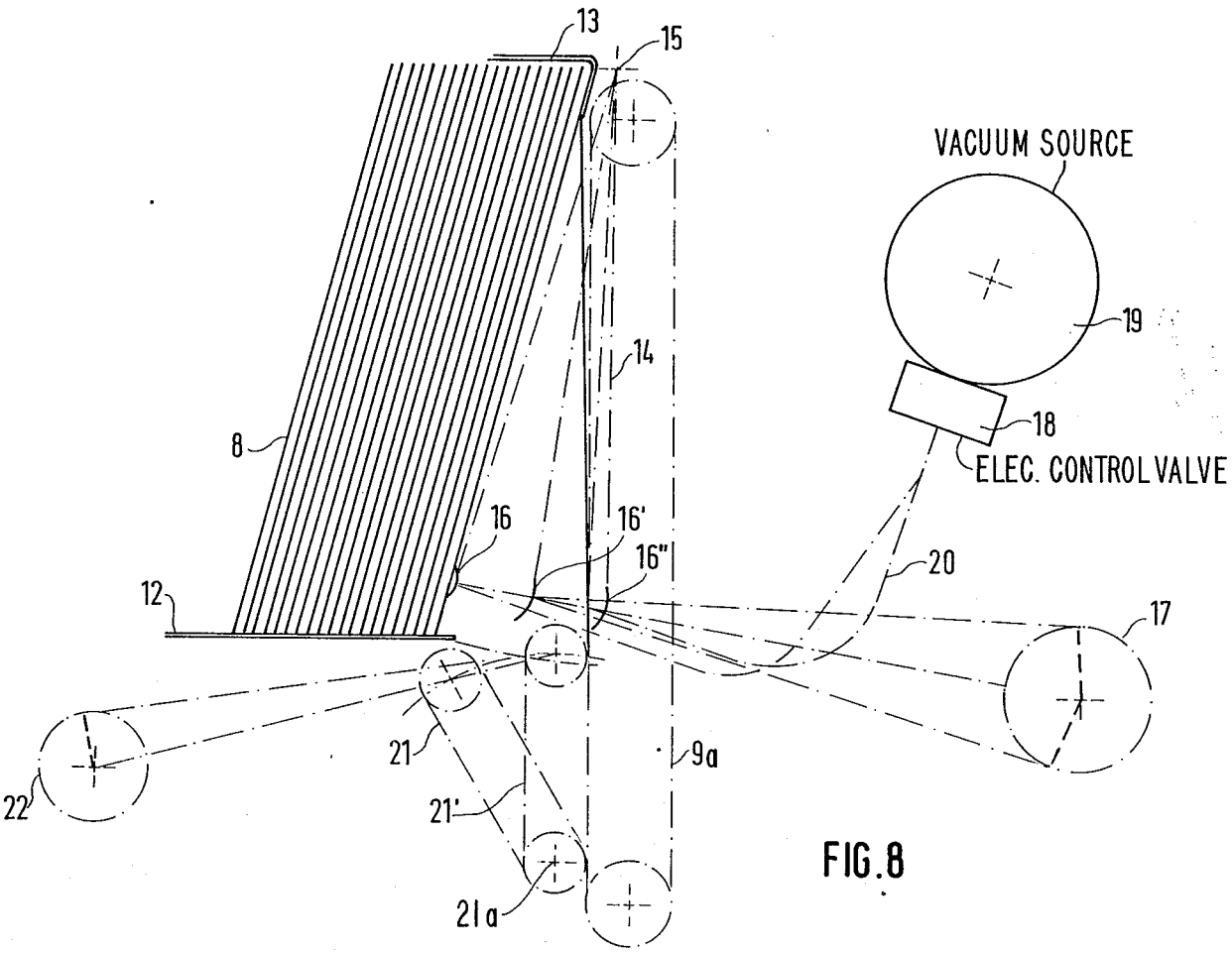
FIG. 8 is an illustration similar to FIG.7, and at a different instant of time in the operating cycle, thereof.

FIG. 6, 7 and 8 illustrate a semi-automatic apparatus to generate the intermediate products 115. Intermediate products are derived, in accordance with distribution routes, while considering the individual requirements of subscribers or distribution regions.

Printed sheets or folded products 8 (FIG. 6) are stacked automatically or by hand and inserted by a transport belt 9 in the respective individual chambers of a storage structure 10, passing under the stack of products 8. The storage structure 10 is similar to the storage structure 4, previously discussed and as explained more clearly in the referenced applications and patents. The individual chambers of the storage structure 10 are already associated with the subscribers, recipients, or the sequence of the distribution route, so that by suitable control of the insertion program, it is only necessary to insert the folded products 8, so that the subscriber or recipient whose name is associated with a specific chamber of the storage structure 10 will receive those inserts or sections which he requested.

The storage structures 10 move, with uniform speed, in the direction of the arrow 11. The chambers will have folded products 8, or sheet products, of similar nature, inserted therein, selectively, and as required. FIGS. 7 and 8 illustrate the insertion stated in greater detail.

The sheet for folded products 8 are held in a sheet-metal frame 12, 13. A suction gripper 16, secured to a pivot arm 14, pivotable about a fixed pivot point or axis 15, picks up the lowermost of the folded products, and pulls it in contact with a continuously running transport belt 9. Upon disconnecting the vacuum of the suction head 16, that folded product is released so that it can relax and its forward end will be caught between the double belts of the transport system 9, releasing the product from the stack and accelerating it in such a manner that the respective product 8 falls into the appropriate chamber of the storage structure being moved therebeneath in accordance with the arrow 11 (FIG. 6).

The pivot or rocking lever 14 and the suction head 16 are oscillated back and forth by a rotating crank device 17, shown only schematically. When a product 8 is required, an electric valve 18 places vacuum from a vacuum supply 19 through a hose 20 to the suction head 16. The timing of gripping of the sheet or folded product is so arranged that the sheets or folded products 8 fall into the appropriate and correct chamber of the storage structure 10 which, as noted, moves with uniform speed. FIG. 7 shows different positions of the suction element 16 at 16', 16'' which, also, causes some deflection of the vacuum hose 20.

The arrangement in FIG. 7 is suitable for single sheets or folded products which can readily be deformed, that is, essentially for comparatively thin inserts. FIG. 8 is similar to FIG. 7, but somewhat more complex, but permits handling thicker folded products or sheets which do not readily bend.

The belt transport system 9 is formed by a primary belt **9*a* and an auxilliary transport belt system 21 which can pivot about a pivot axis 21*a*, under control of a crank drive 22. Crank drive 22 moves the auxiliary belt system 21 back and forth, in cadence, so that in the terminal position shown at 21', the product 8** can be reliably gripped.

The crank drive 22 is synchronized with operation of the swing lever 14 and/or the electrically controlled valve 18.

The valve 18 is controlled by a computer, for example computer 112 (FIG. 3) which has a program associating the particular types of inserts with specific chambers **10.1, 10.2. . . 10.*n***, in order to obtain the desired inserts in the specific chambers which, for example, are coded by numbers.

FIGS. 9 to 26 illustrate a preferred form of a fully automatic arrangement to obtain individual intermediate insert products 115.

Figure 9:
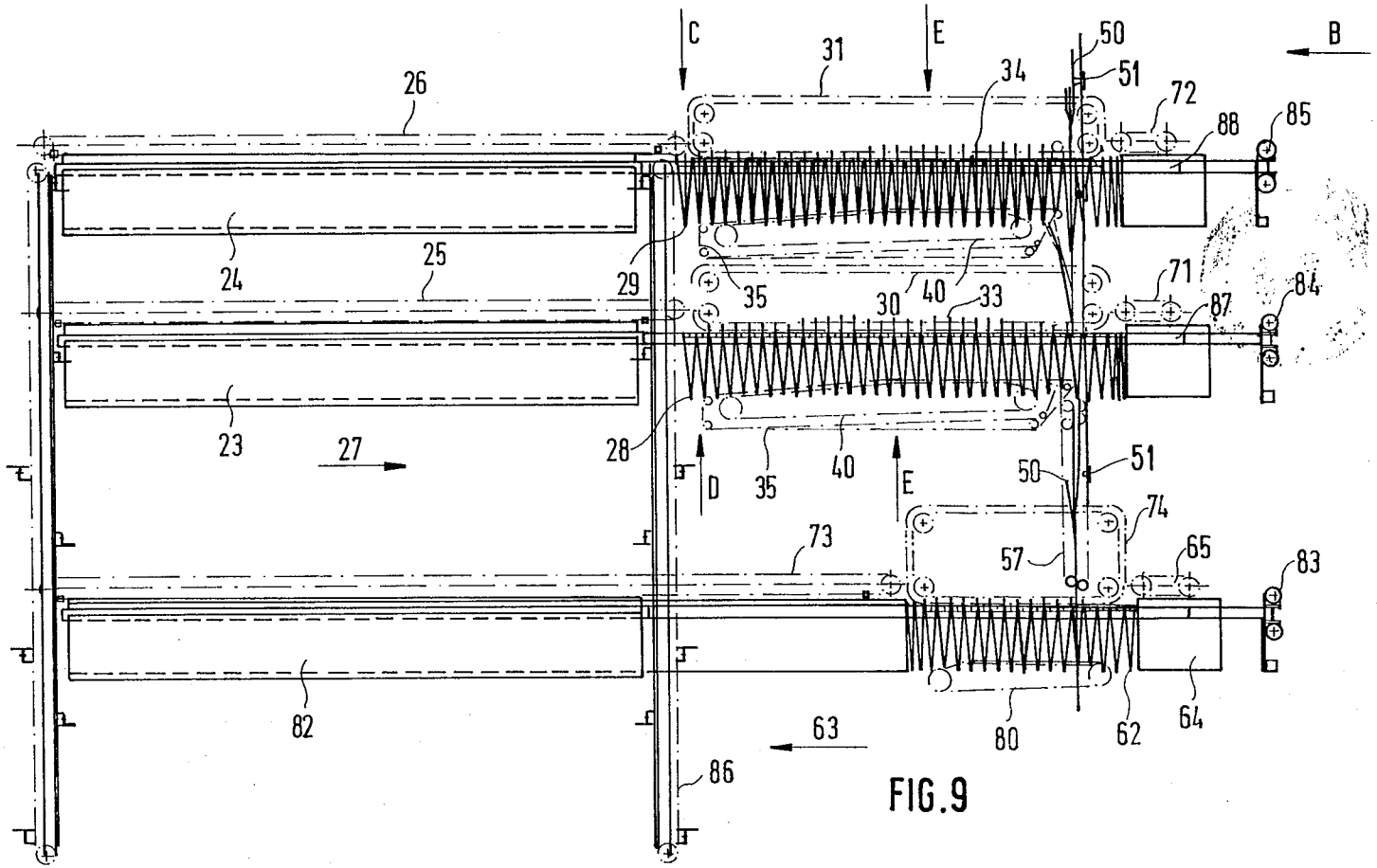
FIG. 9 is a schematic side view of a system for fully automatic formation of intermediate products.
Figure 10:
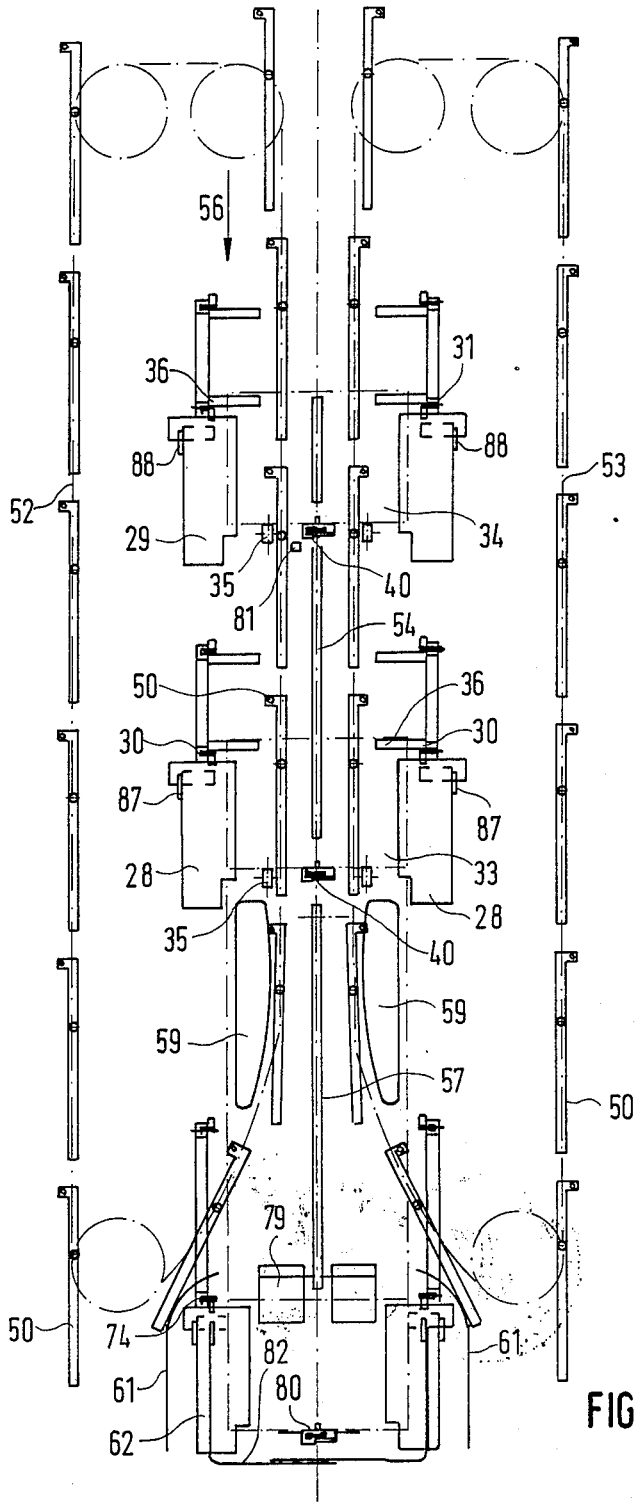
FIG. 10 is a top view of the system of FIG. 9.

FIGS. 9 and 10 are general illustrative figures, giving an overall view of the structure as a whole, FIG. 10 being a view of the structure in the direction of the arrow B of FIG. 9.

Cassettes 23, 24, one located above the other, retain a zig-zag or accordion-like storage structure 28, 29, respectively, in which the storage structures are filled with different inserts, for example inserts 100 (FIG. 1) in storage structure 28 and inserts 102 in storage structure 29. The inserts may, for example, be menswear advertisements or special sections in the upper storage structure 28, and ladies' wear or fashion sections in the storage structure 29. Of course, more than two such sections may be placed above each other, each retaining different types of inserts. Transport chains 25, 26 remove the storage structures from the cassettes 23, 24 in the direction of the arrow 27 (FIG. 9). In the regions marked by arrows C and D, the storage structures 28, 29 are pulled by transport chains 30 and 31 rapidly, by fast-running chains and control disks 32 (FIG. 11) at a predetermined speed and clock rate or cadence, to be expanded, accordion-like, and further transported on guide rails 87, 88, respectively.

The lower storage structure 28 retains folded products 33, forming, for example, the individual inserts 100; the upper storage structure 29 may retain individual advertising sheets, for example coupon sheets, shown schematically at 34.

Figure 11:
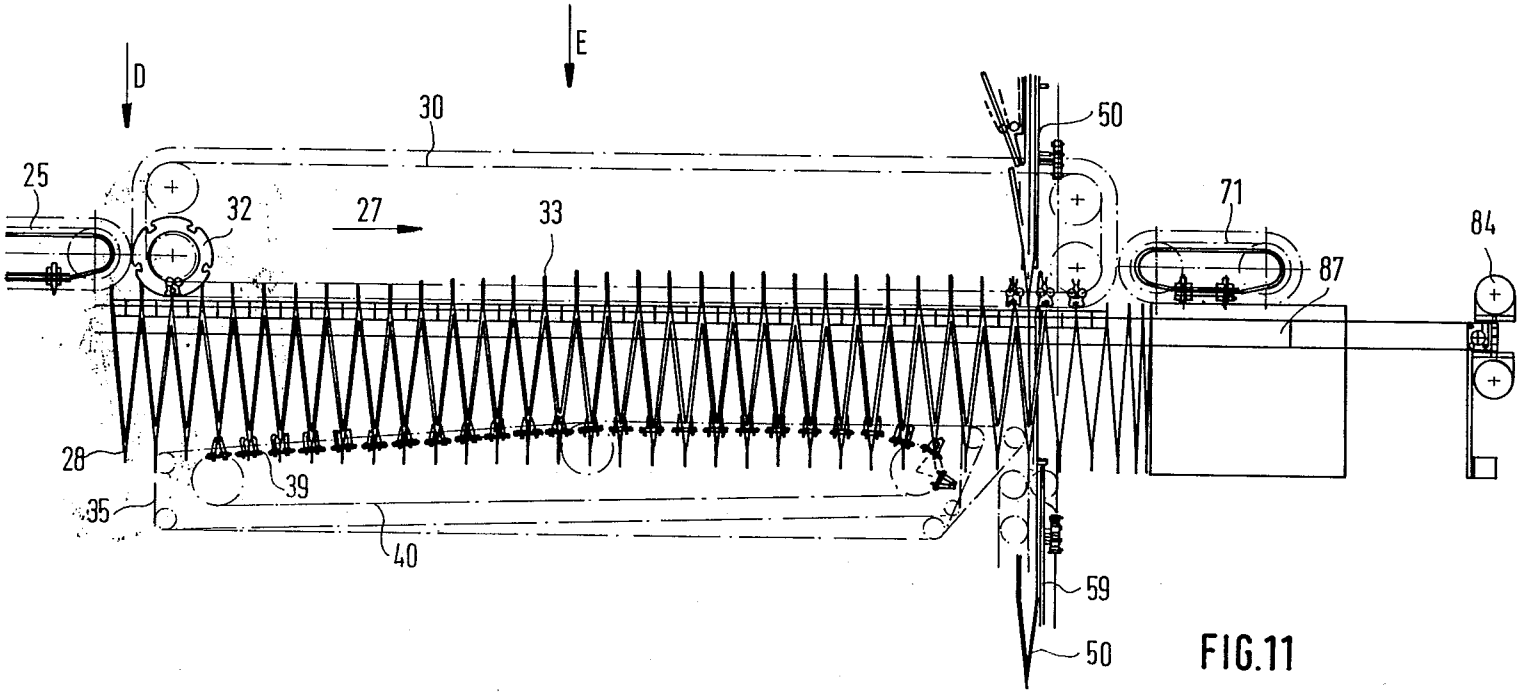
FIG. 11 is a fragmentary side view of a portion of the system of FIG. 9.

An enlarged fragmentary part of FIG. 9 is shown in FIG. 11, and on which further details can be seen. A transport belt 35 lifts the respective folded products 33 and pushes them with their open ends between the fingers 36 —see also FIGS. 20 and 21. The folded products 33 were opened as described in U.S. Ser. No. 07/056,786, of May 29, 1987, now U.S. Pat. No. 4,840,365, by clips 37, 38, which are springy, so that they will open up in the region shown by the arrow D (FIGS. 9, 11). During the lifting step, opened grippers 39 which are secured to a gripper chain 40, operating in the same direction, surrounded the folded lower portion of the folded products 33 to grip the folded products.

In the region E (FIGS. 9, 11), the rails 87 (FIG. 12) expand and guide the storage structures 28 from the region of the folded products 33 so far that they are carried along on the side and held, but are free towards the bottom. To prevent slipping or canting of the folded products, grippers 39 of the gripper chain hold the folded products, and they are substracted from the transport belt 35.

Figure 12:
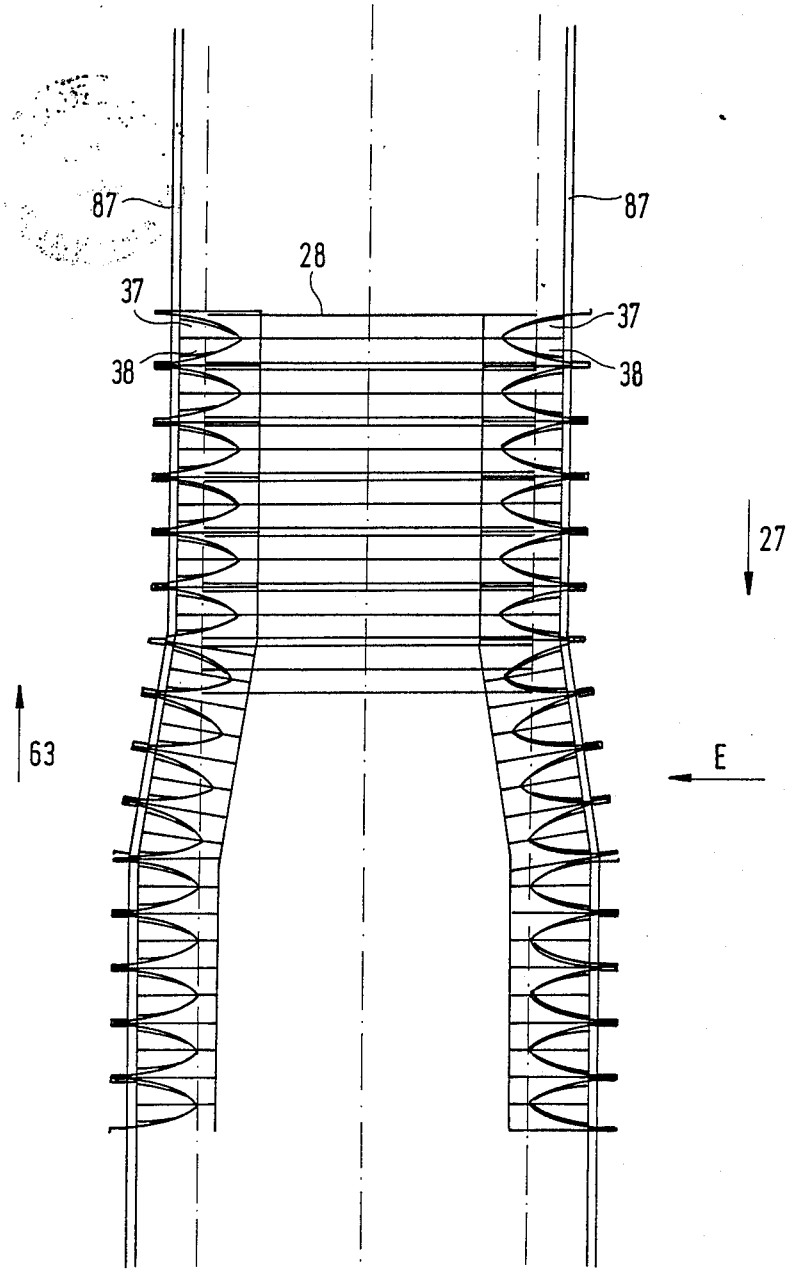
FIG. 12 is a top view of a portion of the system of FIG. 9 and illustrating release of products.

FIG. 12 is a top view of the rail system, showing the smooth outward deflection of the rails in the region E, by an outward bend.

Figure 15:
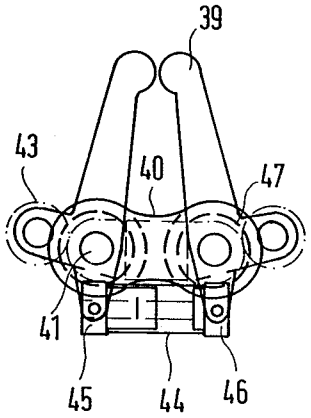
FIG. 15 is a side view of the arrangement of FIG. 14.
Figure 14:
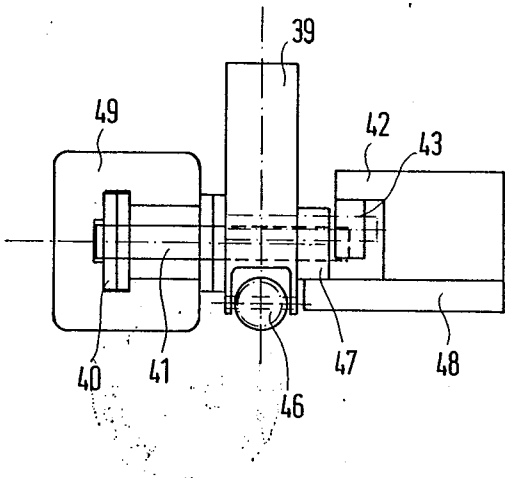
FIG. 14 is an end view of a gripper arrangement.

The gripper chain is shown in greater detail in FIGS. 14 and 15, which show the grippers 39 on the chain 40. Extended chain bolts 41 carry the grippers 39. The grippers themselves are controlled to open and close by a spring 44 having a counter bearing or counter stop 45, 46 at respective ends. Rollers 47 on a roller track 48 forms a holding or guide track, and a counter roller. The gripper chain 40 is supported in a guide track or guided rail 49.

Figure 20:
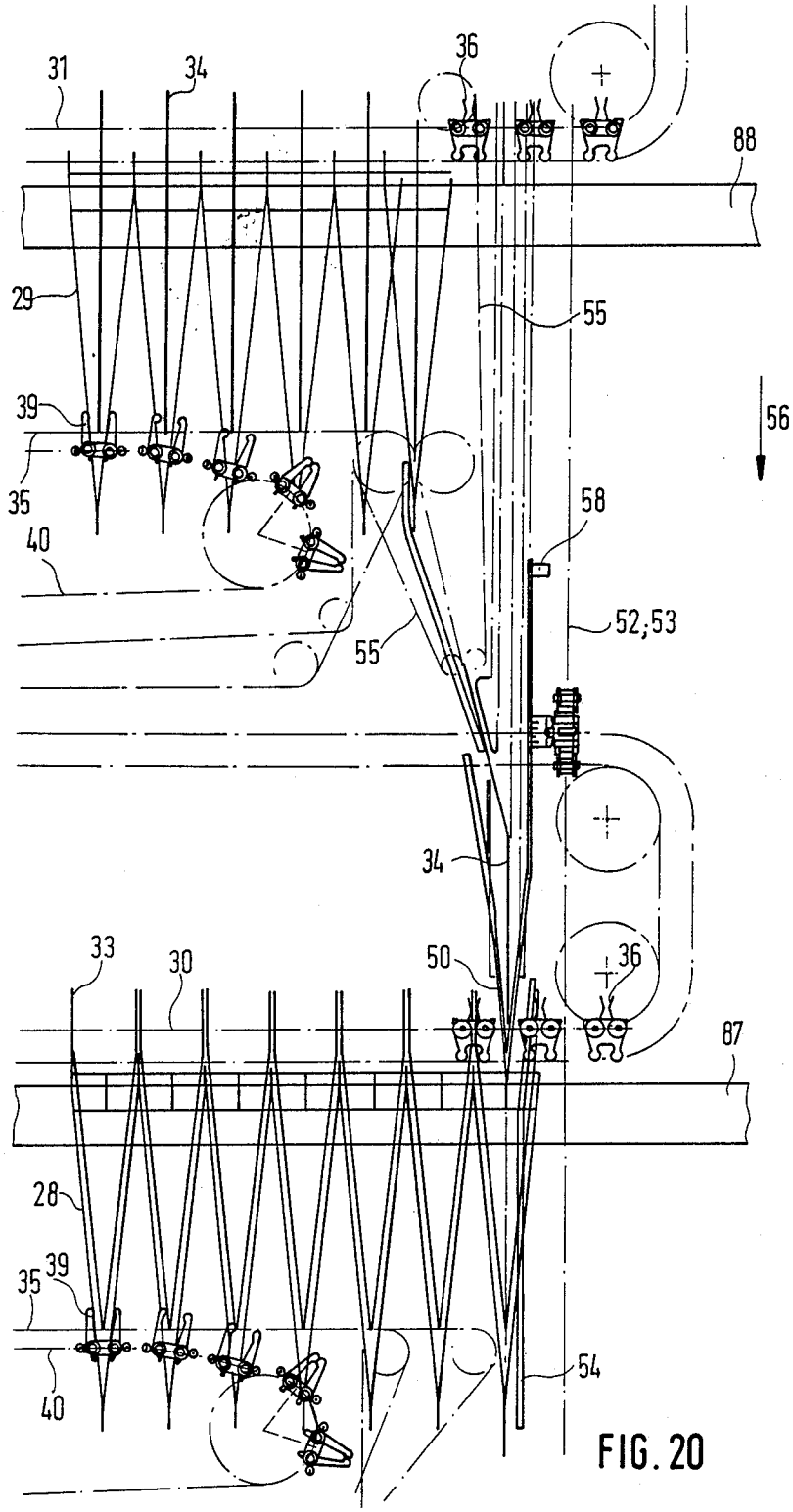
FIG. 20 is a more detailed view illustrating pull-off of packages of printed products from the storage element.
Figure 21:
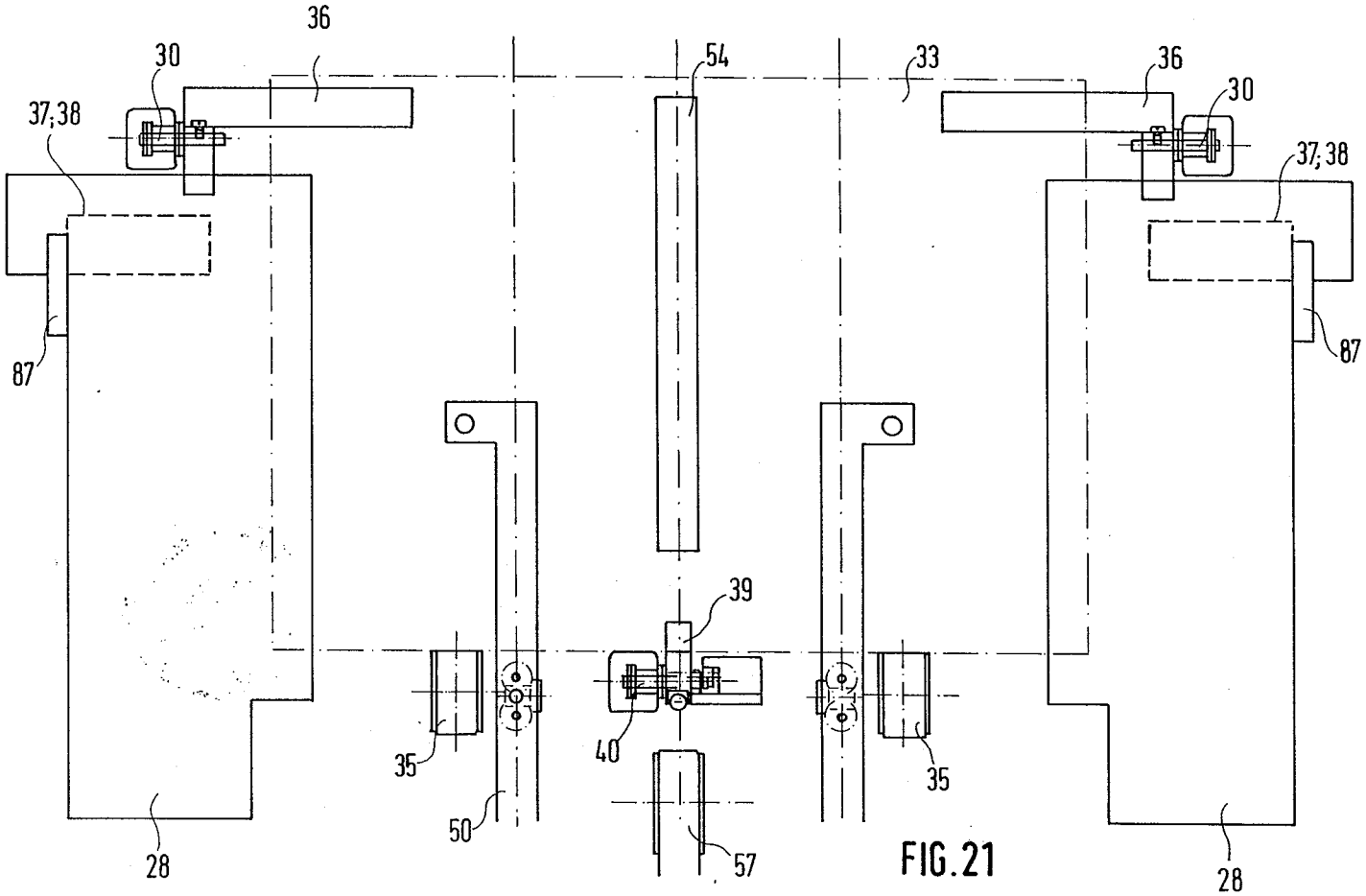
FIG. 21 is an end view of a storage holder, and illustrating operation of the gripper mechanism to pull off a printed product.
Figure 22:
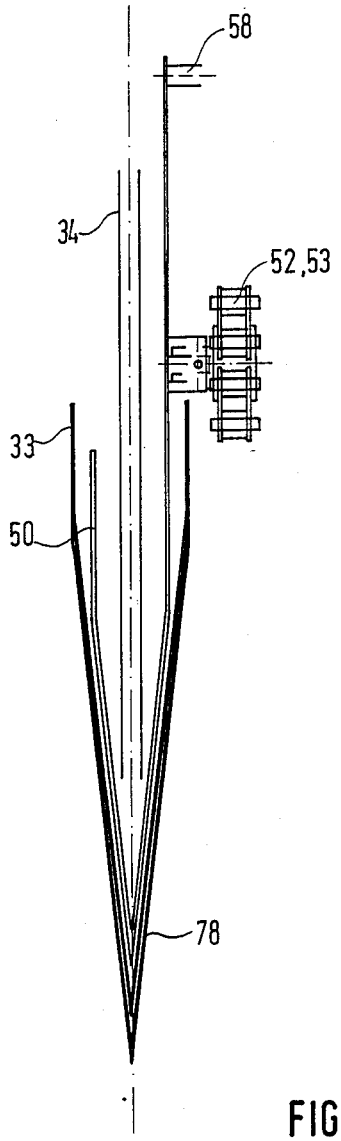
FIG. 22 is a side view of the arrangement of FIG. 21.
Figure 23:
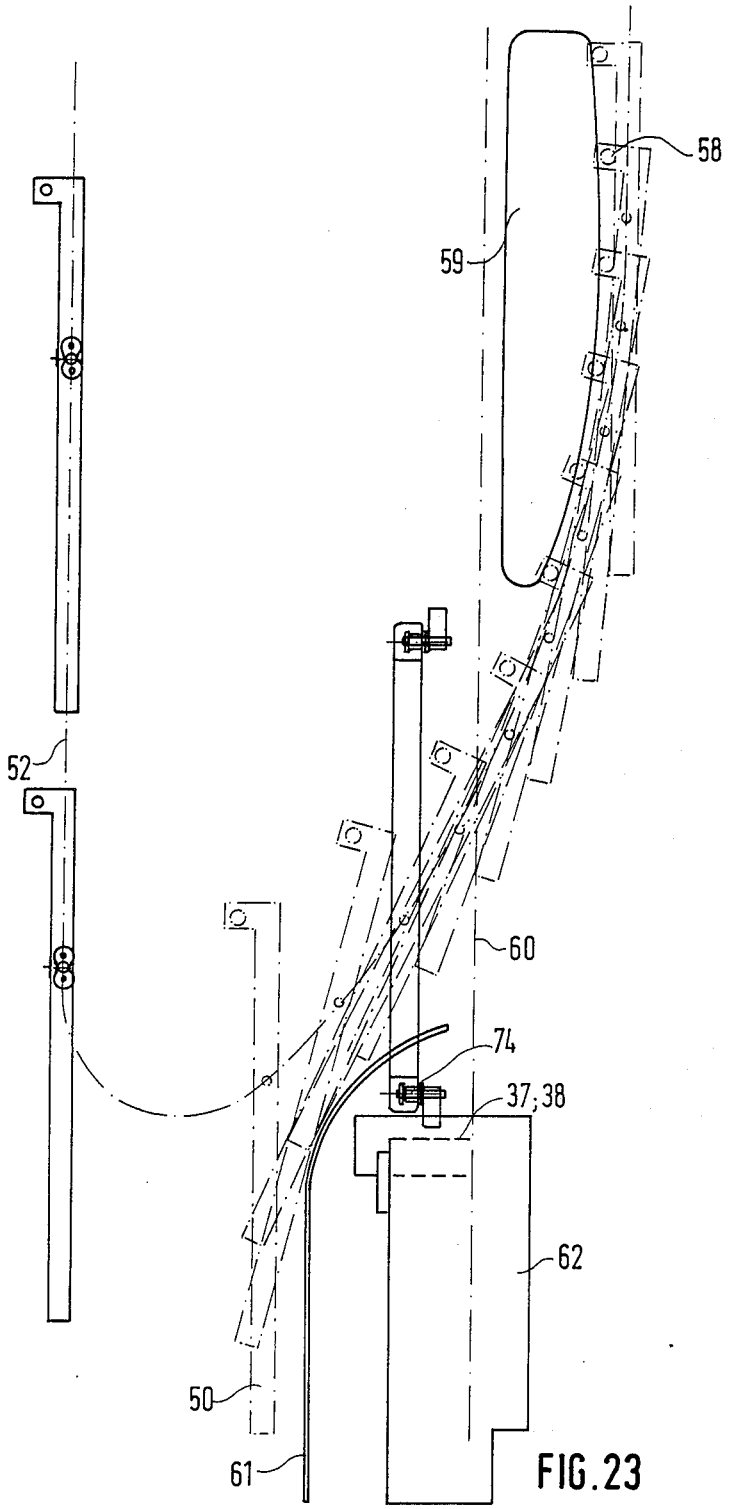
FIG. 23 shows deflection of carrier elements in detail.
Figure 24:
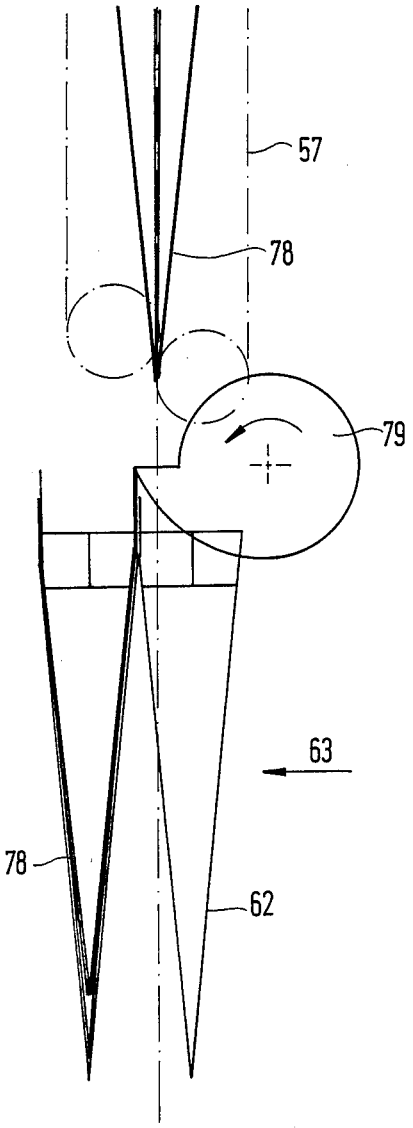
FIGS. 24 and 25 are side views, at different instants of time of controlling the path of printed products by eccenter disks.
Figure 25:
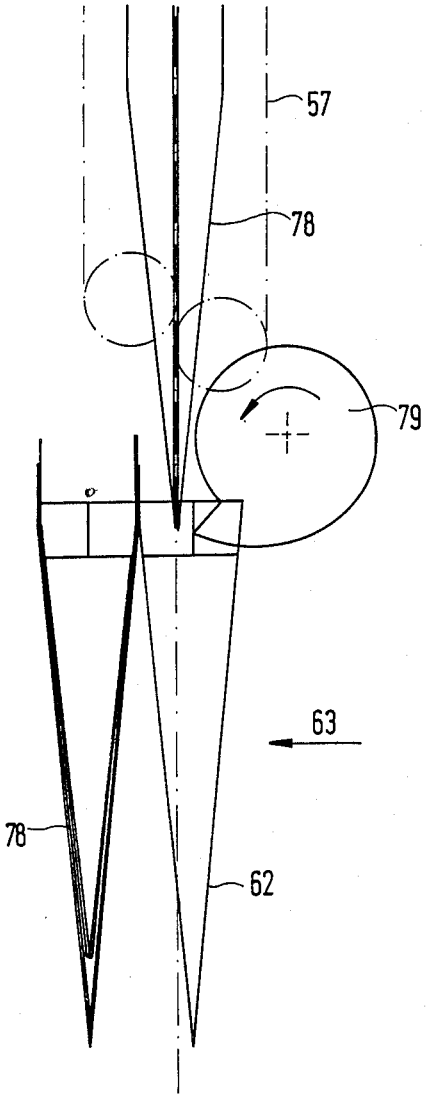

After the storage structures 28, 29 are deflected (see FIG. 12, region E), grippers 39 again release the folded products which, by the transport belt 39 and by the fingers 36 and the spreading structure 28, further transports the folded products. The folded products then will reach the region of the carrier elements 50. As best seen in FIG. 10, carrier structures 50 are pivotable about a hanger pivot 51, which, in turn, is secured to respective chains 52, 53, running about suitable rollers or sprockets, and operating in the direction of the arrow 56 (FIG. 10). To carry along an open folded product 33, the elements 50 engage in the folded product 33 from the top pull it out of the storage structure. A strip 54 prevents that the folded product drops freely, and the folded products slides, upon downward movement, along the strip 54. FIG. 20 illustrates reception of the sheet 34 by the element 50. Sheets 34 are transported from the storage structure 29, the grippers 39 and the belt transport 35 in the same manner as the folded products 33 in the lower storage structure 28. To transfer the sheets 34 to the elements 50, individual sheets 34 are gripped by a belt transport 55, which runs at a fast rate, and are inserted from above into the open elements 50 which are constructed in V or U shape. One follower, thus, can carry out in the direction of movement, that is along arrow 56, collection steps and collect on its front side all opened folded sheets 33 and on its back side, in the U or V-shaped carrier or follow elements 50, all closed folded products, as well as individual sheets 34, as clearly seen in FIG. 22.

The entire individualized intermediate product, forming a package 78, is then gripped by the transport belt 57, operating at the same speed as the chains 52, 53 and carrying the carrier or follower elements 50. The belt system 57 (FIGS. 10, 13) holds the package while the carrier element 50 is deflected laterally, by the pins 58 secured thereto and cam tracks 59 (FIG. 10). The deflection phase is shown to an enlarged scale in FIG. 23. The carrier elements 50 are guided by guide surfaces 61 after lateral deflection from the edge 60 of the sheets. The lateral removal, from both sides, from the package 78 opens the package 78 at the edges. It then enters into the empty zig-zag storage structure 62 described in the referenced applications and patents, so that the spreader elements 37, 38 (FIG. 12) can penetrate between the halves of the spread structure. The structure 62, deflected as previously described in connection with the region E, moves in the direction of arrow 63 with uniform speed. It is continuously replaced by compact, stored storage structure packages 64 (FIG. 13) which, with suitable feed by a transport chain 65, are also moved in the direction of the arrow 63.

Figure 18:
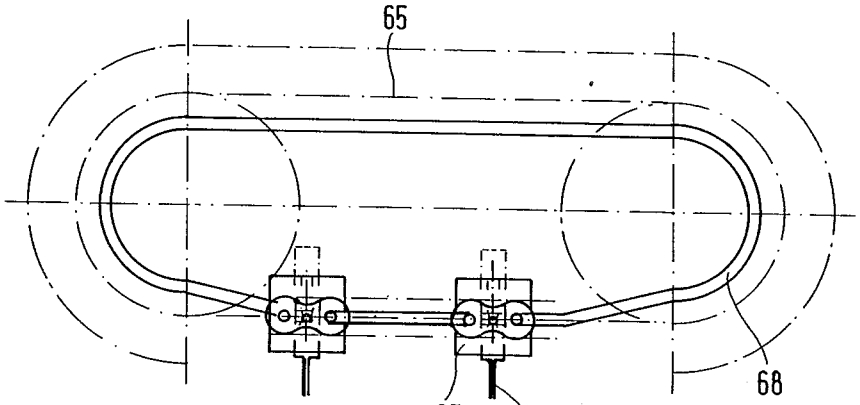
FIG. 18 shows the association of the chain elements of FIGS. 16 and 17 in a chain drive.
Figure 16:
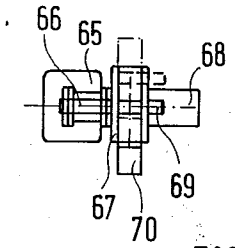
FIG. 16 is a fragmentary to view of a chain drive.
Figure 17:
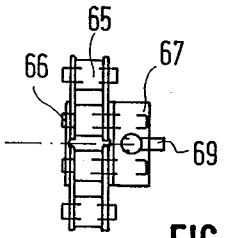
FIG. 17 is side view of FIG. 16.

Referring now to FIGS. 16, 17 and 18:

FIGS. 16 to 18 illustrate a suitable and preferred construction for a chain 65 to feed the storage structures. A chain bolt 66, which is laterally extended, is coupled to guide elements, for example rollers 67, which operate in a guide track, and which control, by means of a pin 69, up and downward movement of a pin or bolt 70. The tip of the bolt 70 is tapered, to form a knife-like tip, which permits entry, from the top, into the closed storage structures 64 and to move them along. Chains 71, 72, 73 as well as chains 25, 26 (FIG. 9), may be of similar construction.

Figure 19:
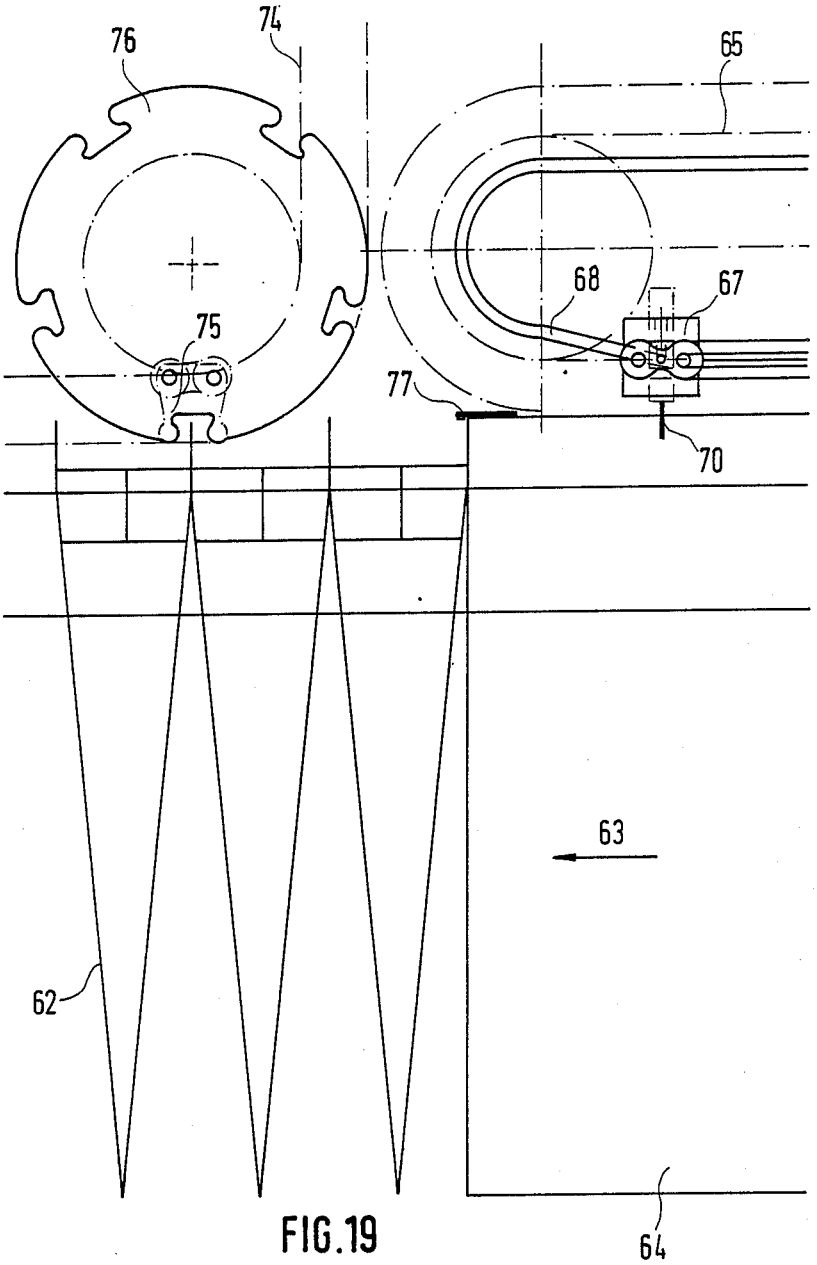
FIG. 19 is a fragmentary view showing the association of the chain drive and a gripper system.

FIG. 19 illustrates in detail the pull-off of storage structure 62 from the package 64 by followers 75 and a control disk 76, about which transport chain 74 runs. A spring tongue prevents uncontrolled separation of the storage structures. Since the storage structure moves continuously in the direction of the arrow 63, a package 78 of intermediate products 115 is moved, initially at least, only in vertical direction, the intermediate product package 78 must be accelerated in the direction of the arrow 63 in which the storage structure moves upon insertion into the storage structure. This is done, in part, by the storage structure 62 which moves and, additionally, by a rotating eccenter disk 79, FIGS. 24, 25. The eccenter disk 79 operates in clocked cadence with the insertion of the sheet, and deflects the sheet package 78 reliably in the direction of the arrow 63 before the next package engages in the storage structure.

Figure 13:
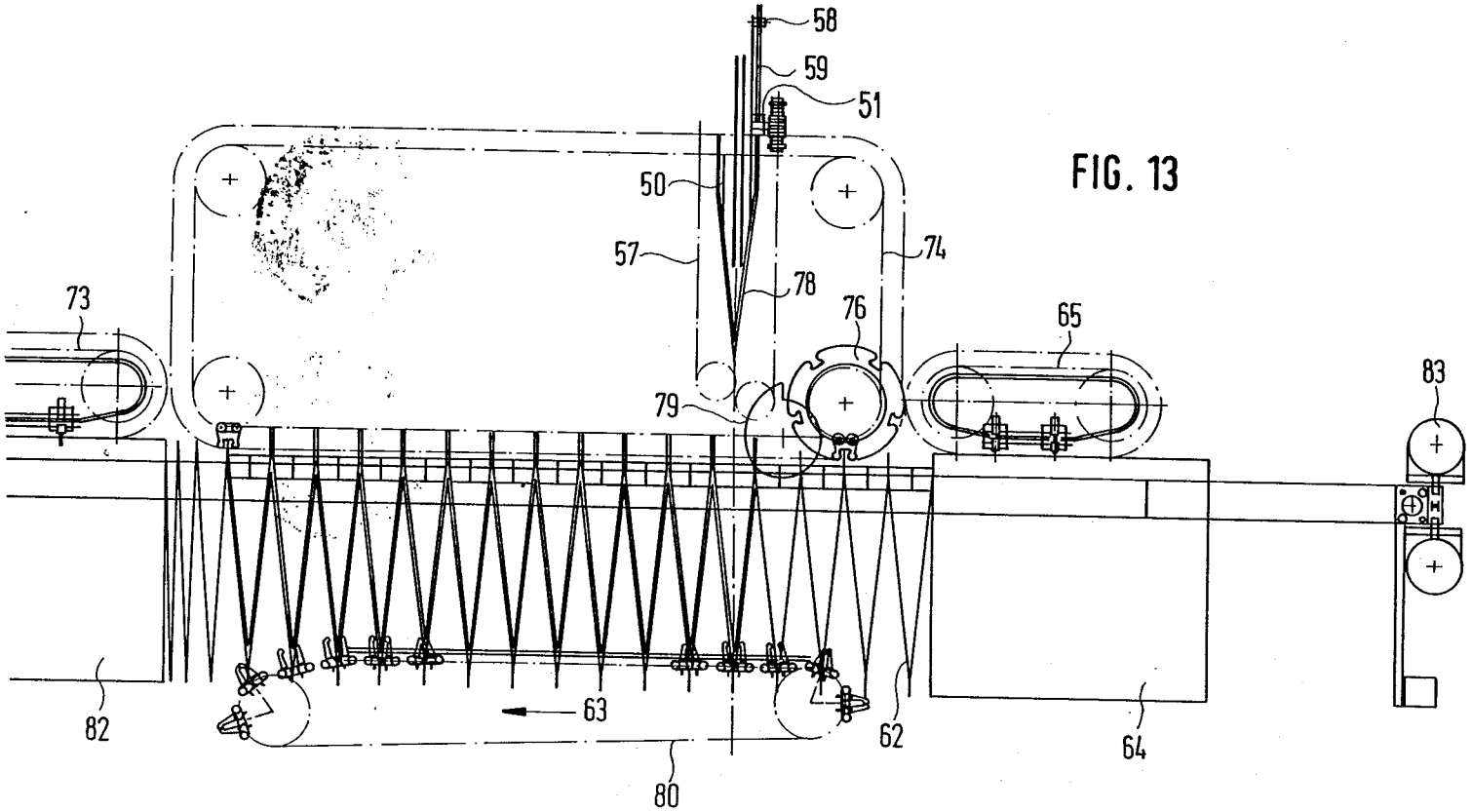
FIG. 13 is a fragmentary side view of another portion of the system of FIG. 9.

FIG. 13 illustrates, further, an endless gripper belt 80, operating in the direction of the arrow 63 which, with open grippers, receives the package 78 to be inserted in the storage structure in order to hold it upon lateral insertion of the spring clips 37, 38 (FIG. 12).

The empty storage structure 62 is continuously moved in the direction of the arrow 63. The transport chains 25, 26, 30 and 31, as well as 71 and 72, and the gripper chain 40 are only then connected when folded products 33 or sheets 34 are to be supplied to the carrier elements 50 (FIG. 9). Control is under a control-computer, and, for example, by the computer 112 ( FIG. 3) which, of course, can also include or control a main timing clock. The timed feed or forward movement corresponds to the length of one chamber of the zig-zag storage structure 28, 29, respectively. The position of the continuously circulating carrier elements 50 is sensed at all times by sensors 81 (FIG. 10). For example, and as illustrated in FIG. 10, a sensor 81 provides signals which controls the further transport of the structure 28 when the then passing carrier element 50 is to pick up a folded product 33.

The system thus provides individually, computer-controlled filling of the chambers at predetermined or, respectively, predefined storage positions of the storage structure 62 in accordance with a product distribution address sequence determined by the computer, and an individual code representing the inserts to be supplied for any individual receiver address which, then, is stored in the storage unit to be then further placed into a storage cassette 82 (FIG. 9). The storage cassette 82 thus forms again an intermediate product store, similar to the store 106 (FIG. 1), having individual chambers filled with individually assembled and associated inserts. Transport towards the filling system or transport away therefrom, that is, transport of empty storage structures, is obtained by the transport systems 83, 84, 85 (FIGS. 9, 11).

Figure 26:
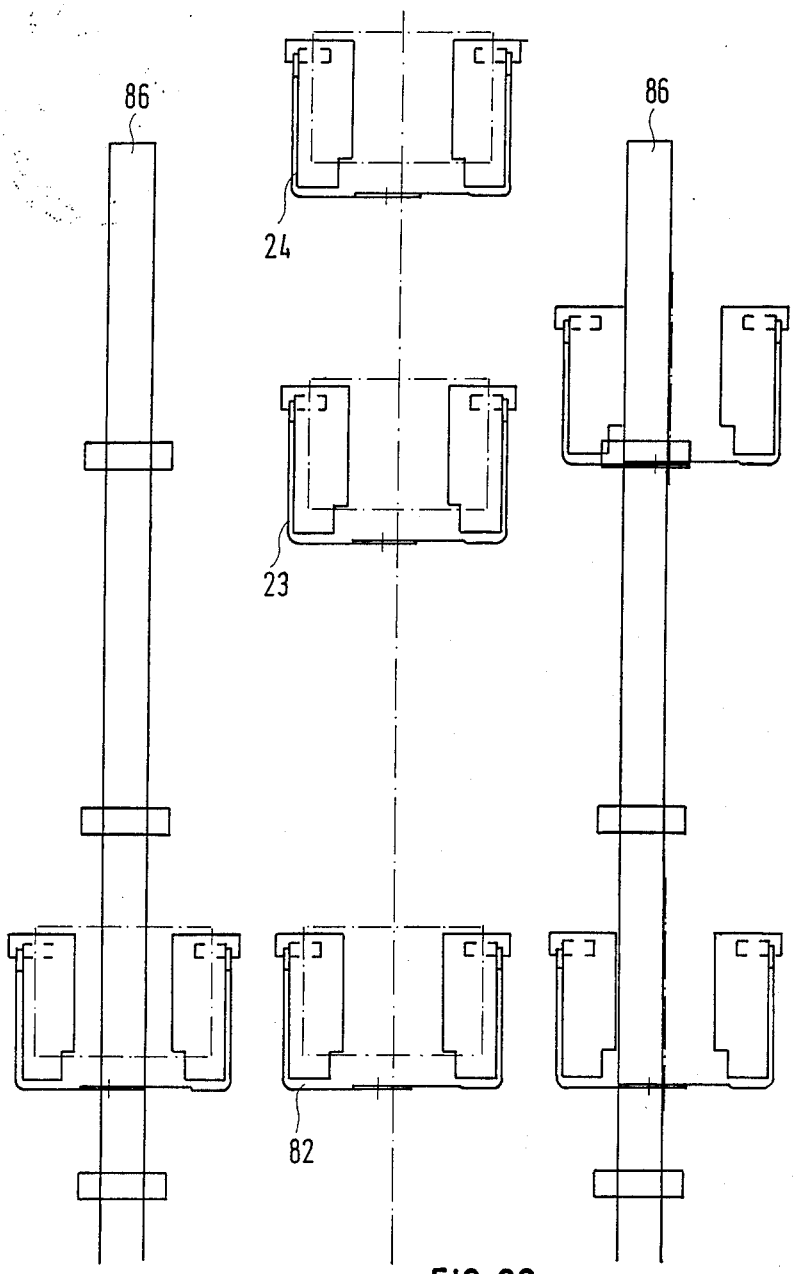
FIG. 26 is a schematic diagram illustrating transport of storage cassettes in vertical direction.

The storage cassettes can be stored in vertical arrangement by a vertical lift storage arrangement shown schematically to an enlarged scale in FIG. 26, which illustrates vertical placement of a plurality of storage cassettes, schematically, above each other as well as next to each other in a vertical rack-type alignment.

Various changes and modifications may be made within the scope of the inventive concept.

I claim:

1. Method of assembling and addressing individualized composite printed products (119), particularly newspapers, magazines or the like, individually selected inserts or sections, having means (101, 103) for retaining a plurality, each, of different inserts or sections (100, 102); and a computer-controller (5, 112), said method comprising, in accordance with the invention, the step of receiving, from a product mixing and storage means (104), under control of the computer-controller (112), selected ones of the inserts or sections (100, 102) from said retaining means (101, 103) to generate intermediate products (115); wherein the computer-controller (112) controls the selection of the respective inserts or sections (101, 102) in accordance with stored data identifying receiver addresses and specific inserts or sections to be delivered to specific receiver addresses to generate said intermediate products associated with said specific addresses;

coding, by coding means (105), the intermediate products (115) with a receiver address distribution sequence code, representative of predetermined sequences or patterns of receiver addresses for delivery of the products to the receiver addresses in accordance with the predetermined receiver address sequence or pattern;

retaining the intermediate products (115) in an intermediate product retaining means (106, 117);

merging each of said intermediate products (115) with identical common product sections (118) received from a common product delivery means (108) while retaining said predetermined sequence or pattern of the receiver addresses, to obtain said composite printed product (119); and addressing the composite printed product (119) by applying a delivery address to the composite printed product in accordance with receiver addressed in said predetermined sequence or pattern as represented by the coding of the intermediate products.

2. The method of claim 1, including the steps of supplying similar inserts or sections (100, 102) to said retaining means;

transferring, from said retaining means, the respective inserts or sections to said product mixing and storage means while, under control of said computer-controller, selectively mixing the products in accordance with data stored in said computer-controller (112) by selectively feeding selected inserts or sections to said product mixing and storage means, and storing said intermediate products in a storage section (117).

and wherein the coding step comprises coding the intermediate products in accordance with said sequence or pattern of receiver addresses.

3. The method of claim 1, wherein the step of merging the intermediate products with identical common products comprises inserting the intermediate products into individual identical common products (118);

reading the codes applied to the intermediate products (115);

and then carrying out said step of addressing the composite printed products in accordance with the codes on the intermediate products.

4. The method of claim 1, further including the step of preliminarily storing said selected ones of the inserts or sections (100, 101) and forming said intermediate product (115) in a preliminary storage means (117), said preliminary storage means having individual storage locations arranged in accordance with the product distribution address sequence or pattern;

and wherein the step of merging the intermediate products (115) with the identical common products (118) comprises transferring the intermediate products to a storage means (116) similar to the preliminary storage means (117) while retaining the product distribution address sequence or pattern in which the intermediate products were stored in the preliminary storage means.

5. The method of claim 4, including the step of introducing the individual selected inserts or sections (100, 102) into individual storage holders or cassettes (113, 114), said individual storage holders and cassettes having storage places coded in accordance with the product production distribution address sequence or pattern.

6. The method of claim 1, wherein the sequence of the receiving step, the controlling step, the coding step, the retaining step, the merging step, and the addressing step are controlled by said computer-controller (112).

7. Apparatus and system for assembling and addressing individualized composite printed products (119), particularly newspapers, magazines, or the like, with individually selected inserts or sections (100, 102), said apparatus having means (101, 103) for retaining a plurality, each, of different inserts or sections (100, 102);

a computer-controller (5, 112);

receiving-storage means (104) for receiving selected ones of the inserts or sections (100, 102) from said retaining means to form intermediate products (115), said computer-controller (112) controlling the selection of respective inserts or sections (100, 102) in accordance with stored identifying receiver addresses, and specific inserts or sections to be delivered to specific receiver addresses;

coding means (105) for coding the intermediate product with a receiver address product distribution address sequence code, representative of the sequences of addresses of the receivers;

intermediate product retaining means (106, 117) for retaining the intermediate products (115) as coded;

identical common product delivery means (108) to supply identical common products;

an insertion or merging station (107) to merge the intermediate coded products, each, with identical common products (118) received from said common product delivery means (108) while retaining the coding of the sequence of the receiver addresses, to obtain a composite printed product (119); and addressing means for addressing the composite printed products by applying a delivery address to the composite printed product in accordance with receiver addresses, as represented by the coding of the intermediate products;

and wherein the intermediate product retaining means (106, 117) comprises zig-zag, accordion-pleated storage means.

8. The apparatus of claim 7, including a holder cassette (1) for retaining additional zig-zag accordion-pleated storage means;

wherein said receiving and storage means (104) comprises at least one of said additional zig-zag accordion-storage means (4) for withdrawal from the storage holder or cassette (1); and computer controlled indicator means (6, 7) indicating which ones of the storage chambers defined between the zig-zag accordion storage means are to be filled with identified inserts or section (100, 102) to indicate to operators which specific inserts or sections are to be placed into specific ones of said chambers, said indicator means being connected to and controlled by said computer-controller (5, 112).

9. The apparatus of claim 7, including means for positioning individual inserts or sections (8; 100, 102) above the zig-zag accordion storage means in generally upright position;

means for relatively moving the zig-zag accordion storage means and said inserts or sections past each other;

and separating means (9, 17, 18, 19, 20) introducing selected ones of said inserts or sections (8, 100, 102) into selected chambers formed between said zig-zag storage means as they move relative to each other and past each other.

10. The apparatus of claim 9, further including a pivotable transport belt system (21, 21') operatively associated with said separating means (9, 17, 18, 19, 20) for positively transporting stiff inserts (FIG. 8);

and vacuum means (16) coupled to said separating means for removing selected inserts from said separating means.

11. The apparatus of claim 7, wherein said product mixing, receiving and storage means (104) comprises additional zig-zag accordion structures;

storage holders or cassettes (24, 23) retaining said additional zig-zag accordion structures (29, 28), said storage holders or cassettes being located above each other, and the respective additional zig-zag accordion storage means retaining respectively different inserts or sections (34, 33; 100, 102);

means for expanding said additional zig-zag accordion storage means;

a plurality of continuously moving carrier elements (50) engageable with said inserts or sections;

continuously removing, by the carrier elements (50), inserts or sections from the expanded accordion storage means in accordance with the product distribution address sequence and the specific inserts required for delivery to specific receiver addresses;

and wherein said insertion or merging station (107) includes a further zig-zag or accordion structure (62) located beneath said additional zig-zag and accordion structure means (29, 28) for introduction of the inserts or sections by said continuously moving carrier elements (50) therein.

12. The apparatus of claim 11, further including continuously moving endless chains (52, 53) to which said continuously moving carrier elements (50) are secured;

means (27) for feeding said additional zig-zag or accordion structure means (29, 28), in steps, and in accordance with the product distribution addresses sequence under control of said controller computer (112), the inserts or sections (34, 33) being introduced by said chambers formed between adjacent zig-zag elements of said zig-zag or accordion-pleated storage means.

13. The apparatus of claim 12, wherein said continuously moving endless chains (52, 53) are positioned adjacent the respective additional zig-zag or accordion-pleated storage means (28, 29);

two chains being provided, and positioned respectively between halves of the storage structures (FIGS. 10), said carrier elements (50) having essentially V shape and receiving folded inserts (33) located in one of the additional zig-zag or accordion-pleated storage means (29) and receiving sheet-form inserts located in another additional zig-zag or accordion-pleated storage means (28) between the carrier elements a belt transport system (55) for transfer to said further zig-zag or accordion-pleated structure (62).

14. The apparatus of claim 13, wherein said carrier elements (50) are pivotably secured to said continuously moving endless chains to permit release of inserts or sections (34, 33) therefrom;

and guide means (54) are provided, located adjacent the belt transport system (55) for guiding said inserts or sections (FIGS. 9, 20).

15. The apparatus of claim 11, further including lifting belts (40) located beneath the additional zig-zag or accordion-pleated storage means (29, 28), said lifting belts terminating short of the carrier elements (50); and an endless gripper chain (35) having grippers (39) thereon located adjacent the lifting belts (40) for gripping the inserts or sections (34, 33; 100, 102) from below and holding said sections in predetermined position upon expansion of the zig-zag accordion storage means, while releasing the inserts or sections (34, 33) in advance of acceptance of the inserts or sections by said carrier elements (50).

16. The apparatus of claim 11, wherein the carrier elements (50) are essentially L-shaped.

17. The apparatus of claim 11, wherein at least some of said inserts or sections are folded products;

and wherein said additional zig-zag accordion storage means include finger elements (36) for engagement between a V opening formed by the folded products (33);

and transport chain means (30) retaining said finger elements (36) for introduction into the folded products.

18. The apparatus of claim 11, further including coding means applied to the storage holders or cassettes (24, 23, 82);

and transport means (26, 86) transporting said storage holders or cassettes to the insertion or merging station (107) in accordance with a predetermined product distribution address sequence of products retained within the storage means retained in the storage holders or cassettes.

19. The apparatus of claim 18, including empty storage holders or cassettes retaining empty additional zig-zag or accordion storage means;

guide track means (88, 87) for guiding the empty storage holders or cassettes in a guide path to a storage region (64) for empty storage holders or cassettes;

and means for returning the empty storage holders or cassettes with the empty additional zig-zag or accordion storage means from the storage region (64) to the receiving and storage means (104, 117).

20. The apparatus of claim 7, including distribution transport means (111) having a predetermined product distribution address sequence route assigned thereto;

positioning means coupled to the product retention means (106, 117) and positioning the product retention means, under control of said computer-controller (112), in operative association with said insertion or merging station (107, 116) for merging the intermediate products with the common products (118) and applying the product distribution addresses in said product distribution address sequence route for loading on the transport means (111).

* * * * *